US006458281B2

(12) United States Patent
Magnoff

(10) Patent No.: US 6,458,281 B2
(45) Date of Patent: Oct. 1, 2002

(54) METHOD FOR SEPARATING SOLID PARTICLES FROM A LIQUID IN A DISH-WASHER

(75) Inventor: Christian Magnoff, Malmo (SE)

(73) Assignee: GS Development AB, Malmo (SE)

( * ) Notice: Subject to any disclaimer, the term of this patent is extended or adjusted under 35 U.S.C. 154(b) by 0 days.

(21) Appl. No.: 09/778,692

(22) Filed: Feb. 7, 2001

(51) Int. Cl.[7] ..... B01D 37/00; B01D 35/22

(52) U.S. Cl. ..... 210/767; 210/791; 210/167; 210/196; 210/409; 210/499; 134/111

(58) Field of Search ..... 210/767, 167, 210/196, 197, 499, 409, 791; 134/111

(56) References Cited

U.S. PATENT DOCUMENTS 4,998,548 A * 3/1991 Lagerstrand ..... 210/167

* cited by examiner

*Primary Examiner*—Robert J. Popovics
(74) *Attorney, Agent, or Firm*—James Ray & Associates

(57) ABSTRACT

The invention relates to a method for separating solid particles from a liquid in a dish-washer. For the separation a filter (19) of expanded metal is provided, which forts openings (21) the bounding surfaces (22) of which are inclined in relation to the plane of the filter. The liquid with particles entrained therein is directed towards descending bounding surfaces in the filter for guiding the liquid flow through the filter under separation of the particles from the liquid.

4 Claims, 1 Drawing Sheet

FIG. 1
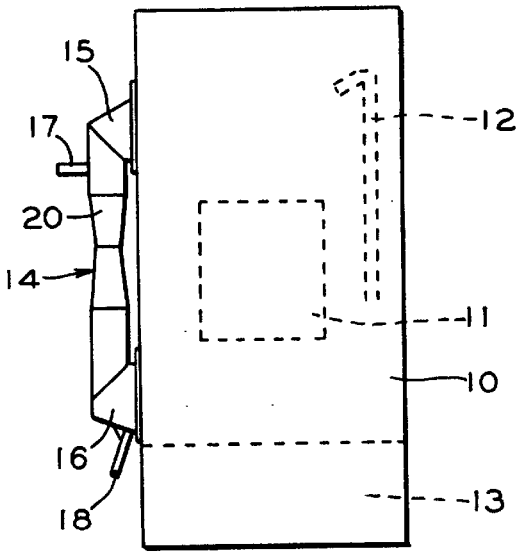
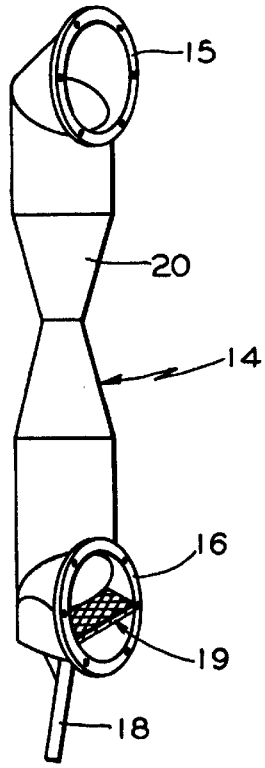
FIG. 2
FIG. 3
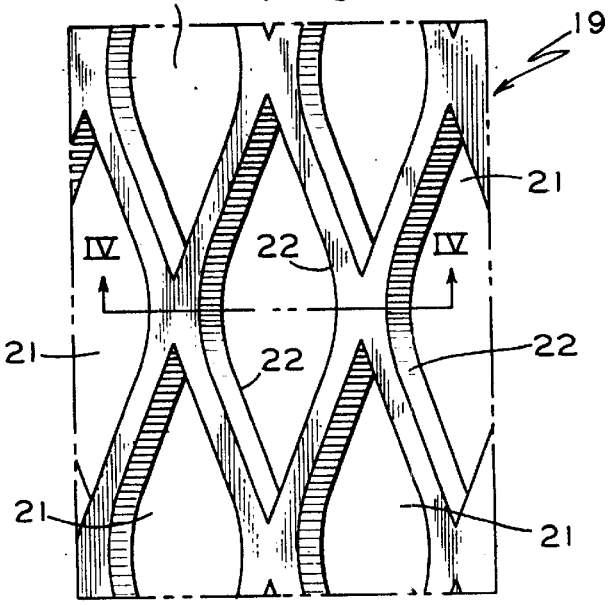
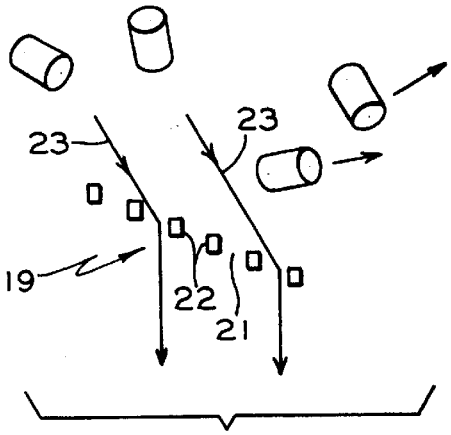
FIG. 5
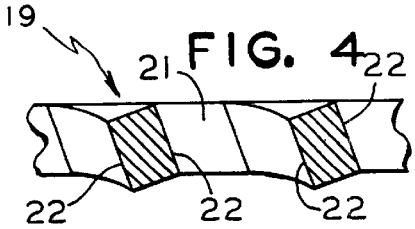
FIG. 4
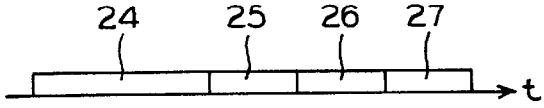
FIG. 6

METHOD FOR SEPARATING SOLID PARTICLES FROM A LIQUID IN A DISH-WASHER

BACKGROUND OF THE INVENTION

1. Field of the Invention

The present invention relates to a method for separating solid particles from a liquid in a dish-washer.

The invention is proposed primarily for a granule dish-washer with a condenser in order to separate granules from the condensation water However, the method according to the invention can be applied also to the separation of food residues from circulating liquid in a dish-washer in order to facilitate the cleaning of a filter used for this separation.

2. Problem Involved

Granules which during a previous dish washing step have collected in the condenser may be carried along by the condensation water to the drain and eventually may clog the filter and as a Consequence thereof prevent the outflow of the condensation water.

BRIEF SUMMARY OF THE INVENTION

The purpose of the invention is to provide a method of the kind referred to above wherein granules entrained in the condensation water are returned to the liquid tank for use in following dishwashing operations.

For this purpose the invention provides a method for separating solid particles from a liquid in a dish-washer, wherein there is provided for said separation a filter of expanded metal which forms openings the bounding surfaces of which are inclined in relation to the plane of the filter, and wherein the liquid with particles entrained therein is directed towards descending bounding surfaces in the filter for guiding the liquid flow through the filter under separation of the particles from the liquid.

BRIEF DESCRIPTION OF THE DRAWING

Embodiments of the invention will be described in order to explain the invention in more details reference being made to the accompanying drawing in which FIG. 1 is a diagrammatic side view of a granule dishwasher, FIG. 2 is a perspective view of a condenser in the dish-washer, FIG. 3 is an enlarged fragmentary plan view of a filter consisting of expanded metal and mounted in the condenser, FIG. 4 is a cross sectional view along line IV—IV in FIG. 3, FIG. 5 is a diagrammatic view illustrating the function of the filter consisting of expanded metal, and FIG. 6 is a diagram disclosing the dishwashing cycle in the granule dish-washer.

DETAILED DESCRIPTION OF THE INVENTION

FIG. 1 discloses diagrammatically a granule dish-washer which in a typical embodiment comprises a cabinet 10 for receiving the goods 11 to be cleaned. A number of spray nozzles 12 are provided in the cabinet, and the lower portion of the cabinet forms a liquid tank 13. On the outside of the cabinet a condenser 14 is mounted which is permanently connected with the interior of the cabinet by upper and lower sleeve couplings 15, 16, The condenser has a connection 17 for supply of cooling water at the top and a closable outlet 18 connected to the lower sleeve coupling 16 for draining off cooling water at the bottom via a filter 19 mounted in the sleeve coupling 16. The filter slopes downwards towards the mouth of the sleeve coupling 16. The central portion 20 of the condenser forms a venturi tube for producing an injection effect in the condenser while cooling water is being supplied through the connection 17.

The filter 19 consists of expanded metal according to FIGS. 3 and 4, i.e. a close-meshed net with openings 21, which is made by tensioning (expanding) a slotted metal sheet. The openings 21 are defined by bounding surfaces 22 which are inclined in relation to the plane of the filter as will be seen in FIG. 4. The filter is mounted in the sleeve coupling 16 in such a way that liquid which enters the coupling 16 from the condenser meets descending bounding surfaces 22 of the filter as will be seen in FIG. 5 wherein liquid arriving from the condenser is indicated by arrows 23.

A dishwashing cycle in a granule dish-washer is illustrated in FIG. 6 wherein the several steps are marked on a time axis. In a first step 24, the dish washing step, liquid at about 65° C. together with granules is pumped from the tank 13 to the nozzles 12, and the jets emanating therefrom are directed towards the goods 11 to be washed, and then the liquid and accompanying granules are returned to the tank in order to be circulated again in the manner described.

In the second step 25 the granules are separated from the liquid and only liquid at 65° C. is circulated in order to rinse the goods. Then, a final rinsing step 26 with clean water at 85° C. is initiated in order to heat and disinfect the goods, and this water is allowed to flow into tank 13 in order to be mixed with the liquid therein the volume of which as a consequence thereof will increase existing surplus being drained off to an outlet conduit via an overflow carrying away solid particles, grease etc. from the surface layer in the tank.

During dish washing and rinsing liquid and granules will enter the condenser 14 because the condenser is permanently connected with the interior of the cabinet, an insignificant amount of liquid being collected in the sleeve coupling 16 below the filter 19 because the outlet 18 is kept closed during these operations. Moreover, some granules adhere to the walls of the condenser by the surface tension of the liquid.

When the final rinsing step 26 has been terminated the machine in its entirety is warm inside and also the goods that have been cleaned are warm. The interior of the cabinet is filled with hot steam. This must be removed before the cabinet is opened for removing the goods, which is effected in a following step 27 by cooling water being sprayed into the condenser 14 at the connection 17 and being allowed to pass through the condenser to the sleeve coupling 16 where the water is drained off through the outlet conduit 18 now open. At the passage through the venturi tube 20 of the condenser, the cooling water provides an injector effect generating a suction through the condenser so that steam is sucked from the interior of the cabinet into the condenser through the sleeve coupling 15. When moving downwards through the condenser the steam will condense. The condensate is drained off together with the cooling water through the conduit 18. Granules which during the dish washing and rinsing steps 24, 25, 26 due to surface tension of the liquid have adhered to the surfaces in the condenser may be entrained in the condensation water, and it is of course desired to retrieve these granules for use in following dish washing cycles. Therefore, they are prevented from being carried along by the water to the outlet 18 by the filter 19 the openings of which are sufficiently small in order that the granules cannot pass therethrough. The water hits the filter from the left as seen in FIGS. 4 and 5 so that it rams the descending inclined bounding surfaces of the filter openings 21 in order to be guided through the openings of the filter and be drained off through the outlet 18 while accompanying granules as well as the granules which have collected on the filter during previous operations will be repelled towards the interior of the cabinet as illustrated in FIG. 5 in order to be received by the tank 13 for reuse in following dish washing steps.

In the embodiment described the filter of expanded metal is mounted in connection with a condenser but it can also be mounted in the circulation system of the granule dishwasher in order to separate granules from liquid circulating in step 24 with granules entrained therein. In that case the filter can be mounted in inclined position in a conduit for the liquid with granules entrained therein so that granules trapped by the filter will roll from the filter through a side outlet connecting to the filter surface, into a drained collection container while the liquid separated from granules passes through the filter and continues to circulate for effecting rinsing with liquid, step 25. The separated granules can then be returned to the liquid for reuse in the dish washing step 24.

A filter of expanded metal preferably is provided also in the overflow from the tank 13 in the dish-washer the outflow from the tank being directed towards the descending bounding surfaces of the filter in the manner described above. Solid particles such as food residues which are separated from the liquid by means of the filter and collect on the surface thereof then can be easily removed from the filter by rinsing the filter with liquid in a direction opposite to that of the outflow from the tank such that this rinsing flow hits the ascending surfaces of the filter. As a consequence thereof the rinsing flow will have a component directed from the surface of the filter, which lifts collected material from the surface of the filter so that the rinsing flow more easily removes the material from the filter.

What is claimed is:

1. A method for separating-solid particles from a liquid in a dishwasher comprising the steps of:

(a) providing a separation filter formed from expanded metal having openings formed there through, said openings being defined by bounding surfaces of said expanded metal, said bounding surfaces being inclined with respect to the plane of the filter; and (b) positioning said filter within said dishwasher such that liquid with particles entrained therein is directed downwards toward descending surfaces of said bounding surfaces in the filter so as to guide the liquid flow through the filter and separate the particles from the liquid.

2. The method according to claim 1 wherein the liquid with particles entrained therein comprises dishwashing liquid with dishwashing granules entrained therein and wherein said separation filter separates said dishwashing granules from said liquid so that said dishwashing granules may be reused in a subsequent dishwashing procedure.

3. The method according to claim 1 wherein the liquid with particles entrained therein comprises cooling and condensation water escaping from a condenser in a granule dishwasher and wherein said separation filter separates said granules from said cooling and condensation water.

4. The method according to claim 1 wherein particles collected on the separation filter are removed there from by means of a liquid flow directed towards ascending bounding surfaces of the separation filter.

* * * * *